US007140309B2

(12) United States Patent
Behunin

(10) Patent No.: US 7,140,309 B2
(45) Date of Patent: Nov. 28, 2006

(54) METHOD OF CLEAN BURNING AND SYSTEM FOR SAME

(75) Inventor: Max D. Behunin, West Valley City, UT (US)

(73) Assignee: New Energy Corporation, Harrisville, UT (US)

( * ) Notice: Subject to any disclaimer, the term of this patent is extended or adjusted under 35 U.S.C. 154(b) by 0 days.

(21) Appl. No.: 10/947,014

(22) Filed: Sep. 22, 2004

(65) Prior Publication Data

US 2005/0061216 A1 Mar. 24, 2005

Related U.S. Application Data

(60) Provisional application No. 60/504,903, filed on Sep. 22, 2003.

(51) Int. Cl.
*F23B 7/00* (2006.01)

(52) U.S. Cl. ..... 110/341; 110/342; 110/229; 110/344

(58) Field of Classification Search ..... 110/229, 110/210, 214, 165 R, 242, 215
See application file for complete search history.

(56) References Cited

U.S. PATENT DOCUMENTS

| | | | | |
|---|---|---|---|---|
| 3,915,105 | A * | 10/1975 | Michelbrink | 110/165 R |
| 4,084,521 | A * | 4/1978 | Herbold et al. | 110/242 |
| 4,308,103 | A * | 12/1981 | Rotter | 202/117 |
| 5,205,225 | A * | 4/1993 | Milsap, III | 110/240 |
| 5,361,710 | A * | 11/1994 | Gutmark et al. | 110/346 |
| 5,553,556 | A * | 9/1996 | Kruger | 110/345 |
| 6,279,492 | B1 * | 8/2001 | Larson et al. | 110/346 |
| 6,619,214 | B1 * | 9/2003 | Walker | 110/229 |

* cited by examiner

*Primary Examiner*—Kenneth Rinehart
(74) *Attorney, Agent, or Firm*—Kirton & McConkie; Michael F. Krieger

(57) ABSTRACT

A method and system for clean burning organic or synthetic material, particularly vulcanized rubber, where fuel is ignited and the heat and smoke by-product is maximized by controlling the amount of oxygen available to the fire. The smoke by-product in an afterburner is reacted with steam, producing hydrogen and carbon monoxide, the products may be collected and stored. The extreme heat in the afterburner reduces the amount of pollutants and toxins in the air. Excess heat generated by burning the fuel may be used to power an engine.

11 Claims, 2 Drawing Sheets

METHOD OF CLEAN BURNING AND SYSTEM FOR SAME

CLAIM OF PRIORITY

This application claims priority to U.S. Provisional Patent Application 60/504,903, filed Sep. 22, 2003.

FIELD OF THE INVENTION

The present invention relates to generating power from organic and/or synthetic fuels. More specifically, the present invention relates to burning tires to create a clean fuel source.

BACKGROUND OF THE INVENTION

Presently there is a shortage of energy for the world's needs. Generally the world relies upon oil and fossil fuel to generate the majority of the electricity consumed by industrial nations. Furthermore, while the finite supply of fossil fuels to continues to dwindle, the demand for energy continues to increase.

As a result of the continued depletion of energy sources and the continued increase of energy demand, many inventions have looked to alternative sources of fuel. The alternative fuel sources include solar power, wind power, or even burning of garbage in landfills. While the need for alternative fuel sources increases, many of those already in use present limited solutions to the current energy problems. These limitations result from the prohibitive costs associated with manufacturing, the alternative fuel source, or as a result of general societal indifference to energy shortage.

While scientists and engineers continue their search for viable alternative fuel sources, industrial nations continue to produce large amounts of waste. Attempts to reduce the amount of waste produced in many nations has resulted in recycling initiatives, government regulations, and reduced consumption. However, several manufactured items do not lend themselves to recycling or other modes of disposal, and thus present a long-term environmental and landfill threat. One such product is vulcanized rubber, or automobile tires. It is estimated that each year at least 1 billion tires are discarded around the world with the majority of those coming from the United States of America. These tires are often placed in large piles which present environmental and health hazards if they were to burn. Controlled tire burning has been seen as a way to alleviate the energy crisis the world faces, yet generally tire fires are logical disasters, due to the extreme pollutants released when the rubber is burnt. Furthermore, it is seen that tire fires contribute to pollutants that can cause global warming. As a result, burning of old tires is not generally seen as a viable option for disposing of tires.

SUMMARY OF THE INVENTION

The present invention teaches a method and system for burning tires in a controlled environment whereby the pollutants generally associated with tire burning are reduced and the energy generated is utilized.

DETAILED DESCRIPTION OF THE INVENTION

The present invention relates to a system where organic or synthetic, combustible material is incinerated and processed to produce a clean heat source or combustible heat for commercial value. Generally, the present invention teaches incinerating organic or synthetic materials, particularly used tires, by placing them in an airtight chamber, lighting the tires on fire, capturing the gaseous byproducts or smoke, super heating the gaseous byproducts, and injecting steam into the super heated byproduct to react the byproduct and the steam. This reaction results in the creation of hydrogen, carbon dioxide as well as other byproducts. This method of burning old tires results in generation of heat in the actual burning which can be used to power a variety of energy generators. In addition, this method of tire burning generates hydrogen which can be captured and used for commercially, beneficial processes. Furthermore, finally, by super heating the gaseous byproducts, the present invention teaches a method of reducing many of the pollutants associated with tire burning, leaving behind the beneficial and clean power sources.

Figure 1:
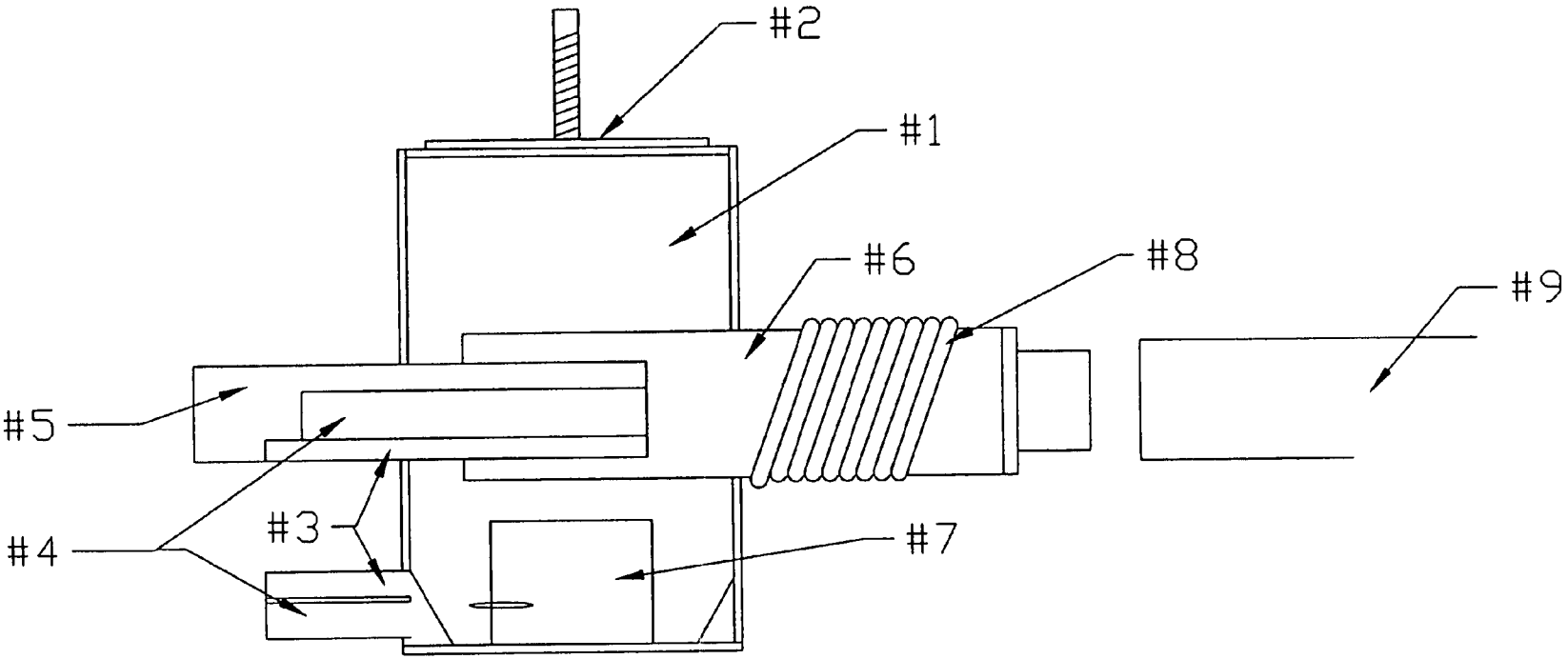
FIG. 1 illustrates a manual feed unit.

Referring now to FIG. 1, there is main reactor chamber 1 with a pressure release door 2 positioned such that it can create an airtight chamber in main reactor chamber 1. Valve control oxygen inlet vent 3 is positioned on the main reactor chamber such that the flow of oxygen can be controlled into the main reactor chamber 1. Finally, gas igniter torch 4 is positioned on the main reactor chamber 1 to ignite the combustible material placed in main reactor chamber 1.

The present invention teaches the user to add sodium into main reactor chamber 1 and then to seal the unit with pressure released door 2 before igniting the organic or synthetic material in chamber 1.

A user of the present invention must monitor the present temperature in the main reactor chamber and regulate the heat at an optimal temperature. This is done by adjusting oxygen vent valves 3. Furthermore, by reducing the amount of oxygen available to the burning material inside reactor chamber 1, the user is able to increase the temperature inside main reactor chamber 1, without consuming the fuel.

In addition to conform to environmental protection and standards, scrubbers may be used. As the combustible materials burn inside main reactor chamber 1, the user will regulate the amount of oxygen to maintain not only the temperature, but also to maximize the amount of smoke being emitted from the burning tires.

The smoke generated by the burning fuel inside chamber 1 is conducted into afterburner 6, where again the user is able to regulate the amount of oxygen available. The oxygen intake in the afterburner is adjusted by manipulating the blower and inlet 5. While the afterburner is filled with the gaseous byproduct or smoke of the burning fuel, steam is injected into the afterburner, thus allowing the steam and gaseous byproduct to react. Steam is generated in copper coils 8 wrapped around the exterior of the afterburner 6. The reaction of the steam with the carbon monoxide in the afterburner yields hydrogen and carbon dioxide and it introduces a water/gas shift into the burner. This water/gas shift supplies the afterburner with a combustible gas to escalate the temperature to burn off the exhaust or gaseous byproduct of the burnt fuel, and cause a clean burn. Once the afterburner has reached the minimum temperature of 1800° f., igniters 4 are turned off, and the system reaches a self-sustaining temperature. The exhaust gases are then forced down an exhaust stack 9 and into a reactor water bath 10.

Water bath 10 sits on top of dispersion grate 11 that allows gas to permeate through the grate 11 and into the water, but doesn't allow the water to descend into stack 9. Vacuum 12 sits above the water line in water bath 10 and sucks gas through exhaust stack 9 and forces it through exhaust outlet 13. By burning at such high temperatures, afterburner 6 is able to burn off toxins in the exhausts typically found when burning tires.

Furthermore, during the first cycle of burning, the oxygen is controlled by a blower and inlet valve 5. This is a delicate process; and to achieve maximum heat output, it has to be monitored and adjusted during the process. Even after the afterburner 6 achieves the minimum operating temperature to be self-sustaining, the user must continue to monitor the temperature and adjust oxygen intake and regulate blower 5 to maintain maximum heat output. Heat output can be used to power a variety of engines, including steam turbine engines and boiler systems. When cooling down the apparatus, the user must monitor the temperature in afterburner 6 until it is 1200° f., at which point the user turns back on the gas burner 4 in main chamber 1 and afterburner 6. This process is continued until the primary fuel inside primary chamber 1 is exhausted. The user then opens the main reactor door 2 and removes the remaining debris for disposal.

Figure 2:
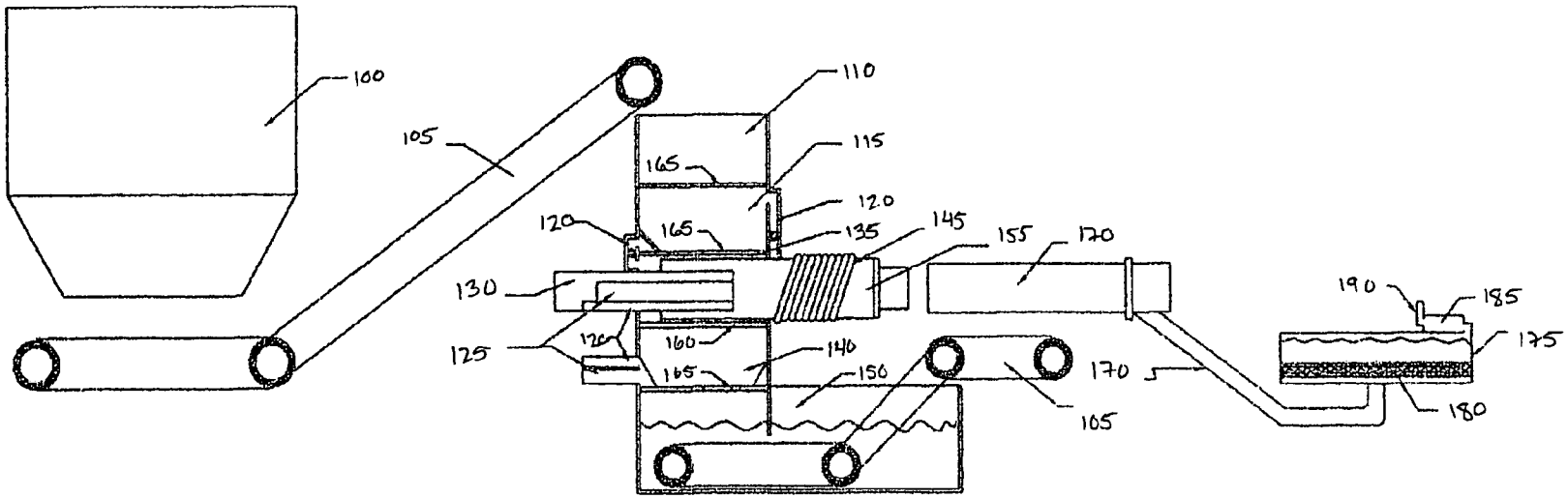
FIG. 2 illustrates an automated gravity feed system.

Turning now to FIG. 2, which illustrates an automated gravity feed system. While the primary function of FIG. 2 is substantially similar to that of FIG. 1, an essential difference lies in that fuel may be continuously loaded into the apparatus of FIG. 2 and thus eliminate the need for manually opening or closing a main reactor door. There is a staging hopper 100 wherein fuel such as used tires may be placed in bulk. A conveyor belt 105 lifts the fuel placed in staging hopper 100 to the top of the gravity fed apparatus. The fuel drops through the limiting hopper 110 which limits the amount of fuel the user can burn at one time. A pair of reactor doors 165 positioned over each of the reactive chambers, and a removable grate 160, is opened to allow the material to gravity feed into the main reactor chamber 140. The removable grate 160 is then closed and the chamber 135 is filled with the combustible fuel. The door 165 over chamber 135 is then closed allowing chamber 115 to fill. The door over 115 is then closed and finally the limiting hopper is filled. Thus there is a steady supply of fuel lined up over a main reaction chamber 140.

To begin burning fuel, vent valves 120 are then opened and the gas burners are ignited to combust the fuel in combustion chamber 140. The temperature in the main reaction chamber 140 can be monitored either manually or by automation to optimize the temperature inside main reactor 140. As discussed above, the temperature in the main reactor chamber 140 is controlled by the amount of oxygen allowed through the vent 125. The temperature in the afterburner 155 must also be monitored; and when the temperature reaches the desired heat to burn the main reactor, the exhaust is allowed into afterburner 155. The amount of oxygen in the afterburner 155 is adjusted by using the blower 130 and vent valves 125.

Copper coils 145 are wrapped around afterburner 155 to convert liquid water into steam. This steam is injected into the afterburner 155 and allowed to react with the gaseous byproduct of the burnt fuel from reaction chamber 140. The desired reaction is carbon monoxide with water to yield hydrogen and carbon dioxide. This reaction causes a water/gas shift in the afterburner and supplies the afterburner 155 with the oxygen and hydrogen to escalate the temperatures to burn off the exhaust and cause a clean burn. This clean burn eliminates many of the pollutants and toxins associated with burning tires in an uncontrolled manner. Once the critical temperature is reached, generally a temperature of over 1800° f., the user may turn off the gas burners and main reactor chamber 140 and afterburner 155, as the system will be self-sustaining after reaching this temperature. The temperature inside the reactor 140 and the afterburner 155 must be continually observed and maintained by adjusting the amount of oxygen allowed through oxygen vent 125 and by incorporating the blower 130. By adjusting these oxygen input mechanisms, the maximum heat output can be obtained.

As stated earlier, these operations and maintenance features can be either performed manually or can be automated. Much of the heat generated in the main reactor and in the afterburner can be utilized to power a variety of energy generating devices such as a steam turbine engine or a boiler system.

The system and method just described can be performed cyclically by allowing the exhausted material in main reaction chamber 140 to drop out of the bottom of the chamber into water bath 150. The removable gate 160 then allows the preheated material from emission chamber 135 to drop into main reactor chamber 140 to be combusted. Similarly, the material in equalizing chamber 115 is allowed to drop into igniting chamber 135 and begin its preheat treatment.

The exhaust that is reacted with the steam in afterburner 155 is then passed through exhaust stack 170 and into reactor 175, which is comprised of dispersion grate 180 and a water bath 150. As with the manual reactor, a vacuum 185 sucks the gas through the dispersion grate 180 and water bath 175 and passes it through exhaust outlet 190. Gas sucked exhaust outlet 190 is then stored for commercially viable purposes.

Beneath main reactor chamber 140 is a water bath 150 wherein a magnetic separator (not shown) collects all commercially valuable material such as the metal radial belts found in automobile tires. These commercially valuable materials are pulled out of the water bath and collected for recycling.

Having described these aspects of the invention, it is understood that the invention defined by the appended claims is not to be limited by particular details set forth in the above description, as many apparent variations thereof are possible without departing from the spirit or scope thereof.

I claim:

1. A method of clean burning comprising:

providing selectively air-tight multi-chamber reactor;

feeding combustible material into said reactor;

burning said material, wherein said burning is manipulated to maximize the amount of gaseous by-product produced by controlling the amount of oxygen present in burning;

channeling gaseous by-product of said ignited material into an afterburner;

injecting steam into said afterburner;

reacting said steam with said gaseous by-products inside said afterburner.

2. The multi-chamber reactor of claim 1 wherein said reactor is automated.

3. The multi-chamber reactor of claim 1 wherein said reactor is manually operated.

4. The combustible material of claim 1 wherein said material is organic material.

5. The combustible material of claim 1 wherein said material is synthetic material.

6. The afterburner of claim 1 wherein said afterburner is heated above 1800 degrees Fahrenheit.

7. The afterburner of claim 1 wherein said injected steam reacts with said gaseous byproduct to produce a mixture of gas comprising hydrogen and carbon dioxide.

8. The method of claim 1 wherein the products of said reaction are captured.

9. The method of claim 1 wherein the products of said reaction are used to power an energy producing device.

10. The method of claim of claim 1 wherein after said material is burned any commercially valuable by-products are separated from refuse.

11. The method of claim 1 wherein scrubbers are installed to make exhaust compliant with environmental standards.

* * * * *